United States Patent [19]

Merrill et al.

[11] Patent Number: 4,755,331

[45] Date of Patent: Jul. 5, 1988

[54] EVAPORATIVE HEAT EXCHANGER WITH ELLIPTICAL TUBE COIL ASSEMBLY

[75] Inventors: Richard P. Merrill, Columbia; George R. Shriver, Sykesville, both of Md.

[73] Assignee: Evapco, Inc., Baltimore, Md.

[21] Appl. No.: 937,165

[22] Filed: Dec. 2, 1986

[51] Int. Cl.[4] ..... B01F 3/04

[52] U.S. Cl. ..... 261/153; 165/172; 165/903

[58] Field of Search ..... 261/153; 165/172, 903

[56] References Cited

U.S. PATENT DOCUMENTS

| | | | |
|---|---|---|---|
| 1,284,578 | 11/1918 | Branzell | 165/172 |
| 1,451,334 | 4/1923 | Ginabat . | |
| 2,076,119 | 4/1937 | Carraway . | |
| 2,139,367 | 12/1938 | Kearney | 165/172 |
| 2,228,484 | 1/1941 | Ramsaur et al. . | |
| 2,454,883 | 11/1948 | Olstad et al. . | |
| 2,680,599 | 6/1954 | Wile . | |
| 2,752,124 | 6/1956 | Nofziger . | |
| 2,805,559 | 9/1957 | Hamilton | 261/153 |
| 2,840,352 | 6/1958 | Ghai et al. . | |
| 2,890,864 | 6/1959 | Stutz . | |
| 2,923,138 | 2/1960 | Rollins . | |
| 2,933,904 | 4/1960 | Wellman . | |
| 3,132,190 | 5/1964 | Engalitcheff . | |
| 3,148,516 | 9/1964 | Kals . | |
| 3,265,372 | 8/1966 | Bradley . | |
| 3,800,553 | 4/1974 | Engalitcheff . | |
| 3,969,450 | 7/1976 | Hengstebeck . | |
| 3,996,314 | 12/1976 | Lakmaker . | |
| 4,196,157 | 4/1980 | Schinner . | |
| 4,434,112 | 2/1984 | Pollock . | |
| 4,577,684 | 3/1986 | Hagemeister | 165/172 |

FOREIGN PATENT DOCUMENTS

| | | | |
|---|---|---|---|
| 458528 | 4/1928 | Fed. Rep. of Germany | 165/172 |
| 3413999 | 11/1985 | Fed. Rep. of Germany | 165/172 |
| 464929 | 4/1914 | France | 165/172 |
| 797453 | 4/1936 | France . | |
| 2134231 | 12/1972 | France . | |
| 2262273 | 9/1975 | France . | |
| 1422611 | 1/1976 | United Kingdom . | |

*Primary Examiner*—Tim Miles

*Attorney, Agent, or Firm*—Panitch Schwarze Jacobs and Nadel

[57] ABSTRACT

The present invention relates to a coil assembly for use in an evaporative parallel flow or counterflow heat exchanger wherein the heat exchanger comprises a conduit oriented in a vertical direction through which external heat exchange fluids flow in a generally vertical direction, the coil assembly being mountable within the conduit, the coil assembly comprising inlet and outlet manifolds and a plurality of tubes connecting the manifolds, the tubes including bights and segments extending generally horizontally across the conduit and connected to at least one bight, the bights being oriented vertically and connecting segments of the tube at different levels within the conduit, the bights of adjacent tubes being in contact with each other, the segments having a generally elliptical cross sectional shape such that the segments of adjacent tubes are spaced from each other in a direction generally normal to the flow direction. The elliptical segments may be angled in the same or opposition directions as long as the spacing is maintained between the segments of adjacent tubes. The bights may have a circular or elliptical cross section.

14 Claims, 4 Drawing Sheets

EVAPORATIVE HEAT EXCHANGER WITH ELLIPTICAL TUBE COIL ASSEMBLY

BACKGROUND OF THE INVENTION

1. Field of The Invention

The present invention relates to a coil assembly for use in an evaporative heat exchange apparatus in which the coil assembly is to be mounted in a vertically oriented duct or conduit of a duct or conduit of the apparatus in which heat exchange fluids, typically a liquid, usually water, and a gas, usually air, flow externally through the coil assembly to cool or condense a heat transfer fluid passing internally through the tubes of the coil assembly. More particularly, the coil assembly of the present invention is most effectively mounted in a counterflow evaporative heat exchanger so that water flows downwardly and externally through the tube assembly while air travels upwardly and externally through the coil assembly.

The coil assembly of the present invention can be used also in a parallel flow evaporative heat exchanger in which the air travels in the same direction over the coil assembly as the water. The evaporation of the water cools the coil assembly and the internal heat transfer fluid inside the tubes forming the coil assembly.

In accordance with the present invention, the coil assembly comprises an array of closely packed serpentine tubes in which the tubes have two different cross sectional dimensions, preferably when viewed in a horizontal plane. Each tube comprises a plurality of two different types of portions, "segments" and "bights" The "segments" are generally straight tube portions which are connected by the "bights", which are the curved portions, sometimes referred to as return bends, to give the tube its serpentine structure. In the preferred embodiment of the coil assembly of the present invention, the segments of each tube are generally elliptical in cross section and the bights are generally circular in cross section. The generally horizontal diameter of the elliptical segments is smaller than the generally horizontal cross sectional dimension of the generally circular bights. If desired, the bights can have an elliptical cross section, so long as the generally horizontal cross sectional dimension of the segments is less than the generally horizontal cross sectional dimension of the bights. In view of these different cross sectional dimensions, segments of adjacent tubes are always spaced from each other even though the bights of adjacent tubes are in contact with each other. The segments are preferably arranged in generally horizontal rows extending across the flow path of the air and water which flow externally through the coil assembly, whether the air and water are in counterflow or in-parallel flow.

The coil assembly of the present invention provides a number of significant advantages. It allows for freer flow of air externally through the coil assembly at lower fan horsepower. It also allows higher spray water flow rates externally over the coil assembly, and thus, higher thermal capacity, without adversely affecting the airflow. It provides for a maximum amount of coil heat transfer surface area within a given coil assembly volume. As a result, the coil assembly provides greater heat transfer capacity. Further, the coil assembly is easy to manufacture and is stronger and more rigid than other designs.

2. Description of The Prior Art

U.S. Pat. Nos. 3,132,190 and 3,265,372 disclose one type of counterflow evaporative heat exchange apparatus in which a coil assembly is mounted in a duct with water sprayed externally downwardly over the coil assembly while air is blown upwardly through the coil assembly. These patents are typical of prior art coil assemblies which will be referred to herein as "tight packed" coil assemblies. In such tight packed coil assemblies, the tubes forming the coils extend in a vertical plane between upper and lower inlet and outlet manifolds in a serpentine manner in which the tubes also extend generally horizontally across the conduit or duct in which the coil assembly is mounted. To maximize the surface area of the tubes being subjected to the external air and water contact, the tubes of the coil are tightly packed together and are in contact with adjacent tubes at the bights and, because the segments and bights have the same cross sectional dimension and shape, they are not spaced apart from each other laterally throughout the entire length of the tube segments. The segments are offset from each other vertically by placing alternate coil circuits at different levels. The open space between two tubes on the same level is equal to the width of the tube in between them. It can be said that a tight packed coil assembly has essentially a 50% open area on each generally horizontal level of segments.

A tight packed coil assembly has the maximum number of tubes that can be built into any given unit width to provide what was thought to be the maximum amount of surface area for a coil assembly for that width. Because of the high number of tubes, the tight packed coil assembly has a relatively low flow of internal fluids flowing within each tube of the coil assembly and a low pressure drop through the interior of the tubes. The airflow pressure drop of the air travelling externally through the coil assembly is relatively high because the tubes are tightly packed together. The external air and water flow through the 50% open area. Spray water flowing down over the coil assembly in a direction opposite the airflow, that is, countercurrent to the airflow, restricts the flow of air to such an extent that the amount of spray water flowing has to be limited as a practical matter to be just enough to wet the coil assembly, but not so much that the airflow rates are adversely affected. Typically, this water flow rate has been limited to values of 1½ to 3 gallons per minute (gpm) per square foot of plan area. Even for parallel flow equipment, where the external air and water flow in the same direction, the 50% open area is still quite restrictive. Similar to counterflow equipment, water flow rates had to be limited so as not to adversely affect the airflow.

In a effort to improve the heat exchange fluid flow characteristics and heat transfer results, another system was developed and is disclosed in U.S. Pat. No. 4,196,157. The coil assembly used in this system will be referred to herein as a "spaced tube" coil assembly. With a spaced tube coil assembly, the tubes forming the coils have serpentine circuits extending between an upper inlet manifold and a lower outlet manifold while also extending generally horizontally across the duct or conduit of the evaporative heat exchanger in which the coil assembly is mounted. However, rather than packing the tubes so tightly that they contact each other, spacers are used so that laterally adjacent tubes are spaced apart from each other along the entire length of tubes, that is, at both the bights and segments, by a distance comprising a narrow critical range. As in the tight packed coil assemblies, in the spaced tube coil assemblies, the segments are offset from each other vertically by placing alternate coil circuits at different levels. Thus, to provide the efficient heat transfer characteristics disclosed in the patent, the tubes of the spaced tube coil assembly must be spaced apart from each other by an amount such that the space between adjacent tube segments at each horizontal level is greater than the diameter of the tubes but is less than twice the tube diameter. In this type of coil, the open area at any horizontal level could range from slightly greater than 50% to a maximum of 67% and in practice has been approximately 55%.

The spaced tube coil assembly provides certain advantages in counterflow and parallel flow heat exchangers compared to the tight packed coil assembly. The open spaces between the laterally adjacent tubes results in a lower pressure drop requiring a lower fan horsepower to move equal amounts of air externally through the coil assembly than if a tight packed coil assembly were used. It allows the spray water flow to be increased somewhat without an adverse performance penalty on the air fan system.

Despite the claimed improvement in counterflow evaporative heat exchange systems using the spaced tube coil assembly compared to a tight packed coil assembly, there are limitations associated with the spaced tube coil assembly. There is a penalty for the tube spacing in that approximately 20% fewer tubes, and therefore, approximately 20% less surface area, can be built into a given unit width. This results in an approximate 20% higher flow per tube and a corresponding approximate 40% higher pressure drop of fluid flowing internally within the coil assembly. What has been gained by the use of lower fan horsepower and improved airflow externally through the coil is offset by the loss in heat transfer surface area. Nevertheless, in practice, systems employing the spaced tube coil assembly have demonstrated capacities almost the same as the systems using the tight packed coil assembly. The primary advantage of using a spaced tube coil assembly has become a cost savings to the manufacturer due to the fewer number of tubes required.

With the present invention, the advantages of the large amount of surface area of the tubes in a tight packed coil system are combined with the enhanced external air and water flow characteristics of a spaced tube coil assembly to provide a significant increase in heat exchange capacity in an evaporative heat exchanger as compared to equipment of the same size using either a tight packed coil assembly or a spaced tube coil assembly. The present invention results in a real advantage both to the manufacturer of the equipment and the customer by increasing the capacity of a unit of given dimensions.

SUMMARY OF THE INVENTION

One aspect of the present invention includes a coil assembly for use in an evaporative heat exchange apparatus in which external heat exchange fluids flow externally through the coil assembly in a flow direction generally normal to a major plane of the coil assembly, the coil assembly comprising inlet and outlet manifolds and a plurality of tubes connecting the manifolds, the tubes having a plurality of segments and a plurality of bights, the bights being oriented in planes parallel to the flow direction, the segments of each tube connecting the bights of each tube and extending between the bights in a direction generally normal to the flow direction, the bights of each tube being in contact with the bights of adjacent tubes, the segments having a generally elliptical cross sectional shape such that the segments of adjacent tubes at the same level in the coil are spaced from each other in a direction generally normal to the flow direction. This spacing does not adversely block and actually enhances the flow of the external heat exchange fluids externally through the coil assembly.

More particularly, the present invention is directed to a coil assembly for use in an evaporative heat exchanger, preferably a counterflow or parallel flow heat exchanger wherein the heat exchanger comprises a conduit oriented in a vertical direction through which external heat exchange fluids flow in a generally vertical direction, the coil assembly being mountable within the conduit, the coil assembly comprising inlet and outlet manifolds and a plurality of tubes connecting the manifolds, the tubes including bights and segments extending generally horizontally across the conduit and connected to at least one bight, the bights being oriented vertically and connecting segments of the tube at different levels within the conduit, the segments of adjacent tubes being staggered and spaced vertically with respect to each other to form a plurality of staggered levels in which every other segment is aligned in the same generally horizontal level, the bights of adjacent tubes being in contact with each other and having a cross sectional horizontal dimension, the segments having a generally elliptical cross sectional shape such that the segments of adjacent tubes at the same level are spaced from each other by an amount greater than the horizontal cross sectional dimension of the bights. The flow of the external heat exchange fluids externally through the coil assembly is enhanced by this spacing.

The present invention also includes evaporative heat exchange apparatus employing the novel coil assembly summarized above and explained in detail hereinafter.

As used herein, the term "generally horizontal" and equivalent terms mean that the segments or other components of the present invention described as being generally horizontal may be inclined upwardly or downwardly within a few degrees. Thus, for example, the segments of a tube typically are inclined downwardly between the bottom of one connecting bight to the top of a bight connected to the other end of the segment. As used herein, the "generally horizontal" includes the angle of inclination of the tube segments between the bights.

As used herein, a "major plane" of the coil assembly means planes generally parallel to those planes containing each level of tube segments within the coil assembly. In the preferred embodiments illustrated in the drawings, for example, the major plane of the coil assembly is generally horizontal.

It is preferred that the distance between the centerline of adjacent bights substantially equals the cross sectional horizontal dimension of the bights and that the space between segments of adjacent tubes at the same level is between about 1.1 and about 1.5, and most preferably, about 1.2, times the horizontal cross sectional dimension of the bights. Preferably, the spacing between the segments results in an open area at any horizontal level of about 55% to about 75%, and most preferably, about 60%.

The coil assembly of the present invention provides the following advantages compared to the prior art in addition to those discussed above. The use of the present invention increases the net amount of heat transfer in an evaporative heat exchanger compared to the prior art; not the heat transfer per unit area of tube surface, but the total heat transfer. As a result, the operating cost per unit of heat transferred is reduced significantly by the present invention compared to the prior art. Since the segments of the tubes between the bights comprise most of the surface area of the coil assembly, the generally elliptical cross sectional area of the segments having their major axes oriented vertically gives more open space between the tubes for airflow and spray water flow than the tight packed coil assembly. Moreover, the spacing of the elliptical segments of the serpentine circuits of the tubes would be defined by the degree of the ellipse and by virtue of the contact of the laterally adjacent bights. This provides the same high number of tubes per unit width as in the tight packed coil assembly and the same high coil surface area per coil assembly plan area as in the tight packed coil assembly. Although there would be a slight loss of flow area internally within the tubes due to the ellipse (on the order of about 5–10%) that would result in an increased pressure drop of about 10% to about 20% over the same type of system using a tight packed coil assembly. However, the present invention would have about 20% to 30% less pressure drop than the spaced tube coil assembly. The overall performance of the coil assembly of the present invention is improved significantly because of the spaced segments.

The 20% increase in space between tube segments at the same horizontal level of adjacent segments of the coil assembly compared to the tight packed coil assembly provides lower resistance to airflow and water flow and also makes it easier to clean the coil assembly. Surprisingly, it has been found that the static pressure resistance to external airflow with the present invention is even lower than it is in the spaced tube coil assembly of the prior art where there is equal open space between lateral tubes in the two systems. This occurs even when using higher spray water flow rates over the coil in the present invention. Higher spray water flow rates are desirable because they result in increased thermal capacity. This is because of improved air and water contact and improved contact of the tube surface with larger amounts of cooling water. It has been found that even at water flow rates up to 8 gpm per square foot of plan area, the present invention shows increased thermal capacity compared to the spaced tube coil assembly which, in practice, is limited to 4.5 gpm of water per square foot of plan area.

The thermal performance of any evaporative cooling device such as this is dependent upon its ability to thoroughly mix the air and water flow streams. The object of an evaporative cooler is to expose as much surface area as possible of the evaporating water to the air, thereby bringing as much of the air as possible to its saturation point. In this invention, large amounts of both the air and water are mixed turbulently inside the device in the region of the coil and provide for improved thermal performance.

Also, the thermal performance of an evaporative cooler depends upon its ability to transfer heat from the internal heat fluid flowing inside the heat exchanger, coil assembly to the external heat exchange fluids (air and water). The amount of heat transferred is a function primarily of the coil assembly surface area but the geometry and construction of the coil assembly plays an essential part in the turbulent mixing of the air and water, as well.

The prior art, using round tubes or tubes of generally equal cross sectional dimensions at the bights and segments have been unable do both, that is, to provide a maximum amount of heat transfer surface area and to provide for good turbulent mixing of large amounts of air and water flowing externally through the coil assembly.

The prior art spaced tube coil assemblies allow the mixing of larger amounts of air and water, but require a coil tube constructed with a greater percentage of open plan area at the expense of lower coil surface area. With the present invention, the surprising result of less resistance to the airflow and the spray water flow has allowed the use of higher spray water flows that provide additional thermal capacity compared to the prior art systems. This is especially important for propeller fan units which are generally less capable of handling high static pressures and have improved efficiency when the static pressure is reduced.

The open area, that is, the spaces between the segments of adjacent tubes at the same horizontal level in the present invention, may be tuned to a particular fan's characteristics by varying the degree of the elliptical cross sectional shape of the segments, the angle of the elliptical segments and the spray water flow rate, thereby allowing the fan to operate at its most efficient point.

Since a tube with an elliptical cross sectional shape will have less flow area than a tube having a circular cross sectional area of the same circumference, the flow velocity inside a tube with elliptical segments will be higher than that of a tube having circular segments. This is also an advantage in that higher velocities within the tube increase the turbulence and the internal film heat transfer coefficient, and thus, the thermal performance of the coil assembly, as compared to the tight packed coil assembly using tubes having a uniform circular cross sectional shape.

The coil assembly of the present invention can be applied to both counterflow and parallel flow evaporative heat exchangers. In both of these designs, performance is maximized by providing the greatest amount of water or other liquid and the greatest amount of air or other gas (the external heat exchange fluids) in intimate and efficient contact with each other and in contact with the greatest amount of coil surface area.

The manufacture of the coil assembly of the present invention is easier than the construction of the prior art spaced tube coil assemblies. No special spacers are required to maintain a critical spacing between tubes. This eliminates the special handling required during the preliminary processing and assembly of the units. By tightly packing together the bights in the present invention, the novel coil assembly is much more rigid than the prior art spaced tube coil assemblies. The compound curvature of the tightly packed bights makes the coil assembly of the present invention very strong.

In summary, the present invention provides for improved airflow characteristics without losing any surface area or tubes. The coil assembly of the present invention permits even higher spray water flow over the coil and higher thermal performance without penalizing the fan performance. The pressure drop of fluid flowing in the interior of the coils has increased, but by much less than half of the increase of the spaced tube coil assembly as compared to the tight packed coil assembly. All of these benefits combine in this invention to produce a unit with greater thermal capacity than other designs, and it is able to fit in a smaller space than prior art spaced tube coil assemblies with the same number and size of tubes with the same spacing between segments. The lower space requirements are very important because of end user construction costs and building volume that could be used for more important income producing purposes.

BRIEF DESCRIPTION OF THE DRAWINGS

For the purpose of illustrating the invention there is shown in the drawings a form which is presently preferred; it being understood, however, that this invention is not limited to the precise arrangements and instrumentalities shown.

DETAILED DESCRIPTION OF THE PREFERRED EMBODIMENTS

Figure 1:
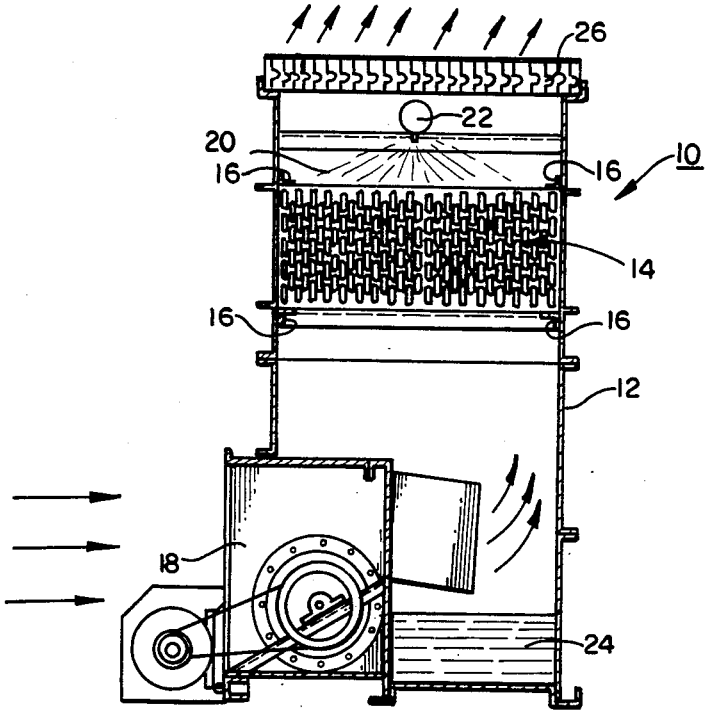
FIG. 1 is a side elevational view, partially in section of a first embodiment of a counterflow evaporative heat exchanger in which is mounted the coil assembly of the present invention.

With reference to the drawings, wherein reference numerals and reference letters represent like elements, there is shown in FIG. 1 a first embodiment of an evaporative heat exchanger 10 built in accordance with the present invention. Heat exchanger 10 includes a generally vertical duct or conduit 12 typically made of galvanized sheet metal. A coil assembly of the present invention 14 is mounted in conduit 12 in any suitable manner such as by being bolted to support brackets 16. Although conduit 12 is shown as being oriented in a vertical direction, which is by far the most typical case, conduit 12 could be oriented in any other direction, as long as coil assembly 14 is mounted within the conduit such that the major plane of the coil assembly is generally normal to the flow direction of external heat exchange fluids flowing externally through the coil assembly. Preferably, the major plane, represented by a plane resting on the top of coil assembly 14 or on the second level of segments within the coil assembly, is generally horizontal.

A blower assembly 18, which may be a centrifugal blower as illustrated or a propeller type fan (not illustrated), blows a gaseous heat exchange fluid, typically air, into conduit 12 and externally through coil assembly 14. If desired, instead of having a forced draft blower system, in which the fan or blower is mounted at the bottom of conduit 12, the system could be an induced draft unit in which the blower or fan is mounted on the top of the unit.

An external heat exchange liquid 20, typically water, is sprayed in a direction counter to the flow of the air by spray assembly 22 externally through coil assembly 14. Although the external heat exchange fluids could be gases and liquids other than air and water, this invention will be described hereinafter by referring to air and water as exemplary of any other suitable fluids. Water 20 thereby coats the surfaces of the tubes forming the coil assembly. As the air travels externally through the coil assembly, the water is evaporated, thus cooling the surfaces of the tubes, and by conduction, cooling the internal heat transfer fluid flowing within the inside of the tubes. Thus, heat is exchanged among the air and water and the internal heat transfer fluid.

Water 20 flows downwardly through conduit 12 into a sump area 24 where it can be recycled to spray assembly 22 or discharged. The air laden with mist travels through a drift eliminator assembly 26 which removes most of the mist from the air before it exits from the heat exchanger as indicated by the arrows above the heat exchanger. Any suitable drift eliminators may be used, although the preferred drift eliminators are those disclosed in U.S. Pat. No. 4,500,330, assigned to the assignee of the present invention and application.

If it is desired to use the coil assembly of the present invention in a parallel flow heat exchanger, in which the air flows in the same direction as the water, one skilled in the art would be able to modify apparatus 10 readily. For example, a blower could be mounted on the top of conduit 12 to blow air downwardly through the coil assembly and drift eliminators could be located below the level of the coil assembly. Many other modifications are possible and it is not believed necessary to describe them since they would be readily apparent to one of ordinary skill in the art.

Figure 2:
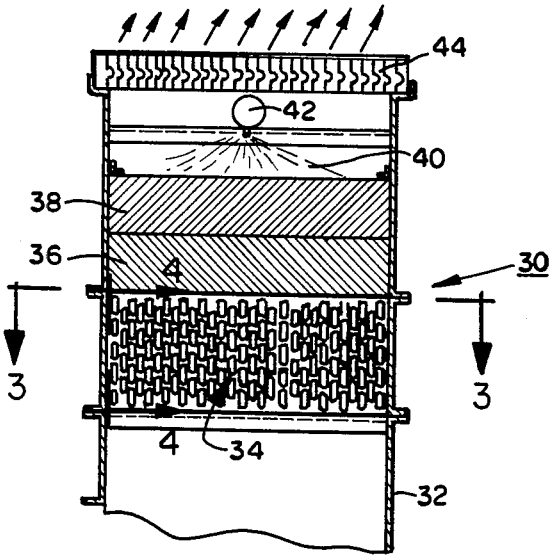
FIG. 2 is a side elevational view, partially broken away and partially in section, of a second embodiment of a counterflow evaporative heat lo exchanger in which is mounted the coil assembly of the present invention.

FIG. 2 illustrates an alternate embodiment of a counterflow evaporative heat exchanger 30 in accordance with the present invention. Heat exchanger 30 includes a duct or conduit 32 in which is mounted in any suitable manner a coil assembly 34 according to the present invention. Air or other gas is blown upwardly through the coil assembly, and then through first and second stages 36, 38, respectively, of contact bodies, sometimes called wet deck fill, which further enhances the heat transfer between the water and the air. Although two decks of contact bodies are shown, one deck or level may be sufficient in many instances. Also, the wet deck fill may be placed below the coil assembly instead of above it, if desired. As indicated by the absence of any contact bodies in FIG. 1, the use of contact bodies is optional. Contact bodies of the type suitable for use in heat exchanger 30 are well known to those of ordinary skill in the art. However, it is presently preferred to use contact bodies, of the type disclosed in U.S. Pat. No. 4,579,694, assigned to the assignee of the present invention and application.

Water 40 is sprayed by spray assembly 42 through the contact bodies 36 and 38 and onto the surfaces of coil assembly 34 where the evaporative heat exchange takes place as discussed above. The water then is collected in a sump (not shown) as described above and mist laden air passes through a drift eliminator assembly 44 as it exits the heat exchanger. The apparatus of FIG. 2 could also be modified readily to operate in a parallel flow manner instead of a counterflow manner.

Figure 3:
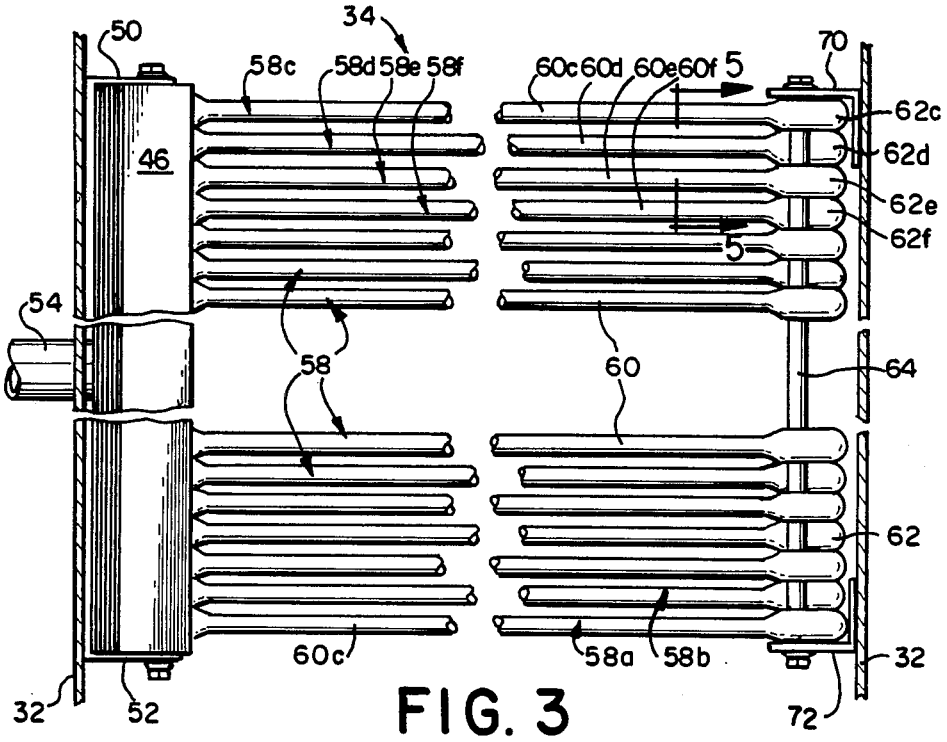
FIG. 3 is a horizontal sectional view of a heat exchanger, partially broken away, showing a plan view of the coil assembly taken along line 3—3 of FIG. 2, and rotated 90 degrees counterclockwise.
Figure 4:
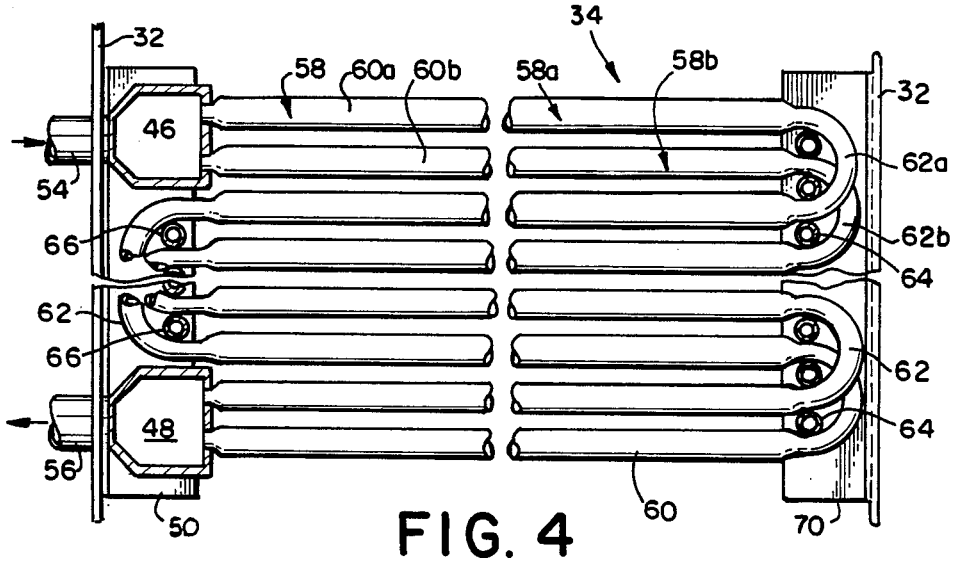
FIG. 4 is a vertical sectional view, partially broken away, of the heat exchanger and coil assembly taken along line 4—4 of FIG. 2.

The details of the coil assembly of the present invention will now be described with initial reference to FIGS. 3 and 4 showing, in essence, a partial plan view of coil assembly 34 in FIG. 3 and a partial sectional or side view of coil assembly 34 in FIG. 4.

Coil assembly 34, which is constructed in a manner substantially identical to coil assembly 14 of FIG. 1, comprises an upper inlet manifold 46 and a lower outlet manifold 48 which extend generally horizontally across the interior of conduit 32. The manifolds are mounted on an interior side wall of conduit 32 by a pair of brackets 50 and 52. The brackets may be supported by or attached to brackets such as brackets 16 illustrated in FIG. 1. An inlet conduit 54 extends through the side wall of duct or conduit 32 and communicates with the upper inlet manifold 46. Likewise, an outlet conduit 56 extends through the side wall of duct or conduit 32 and communicates with the lower, outlet manifold 48. The fluid conduits are connected to a source of an internal heat transfer fluid to be cooled or condensed, for example a refrigerant from a compressor in an air conditioning system (not shown).

Bights 62 of coil assembly 34 are supported by horizontally extending support rods 64 and 66. Support rods 64 are mounted between brackets 70 and 72 that are attached to the side wall of the duct or conduit 32 opposite the side wall on which the manifolds are mounted. Support rods 66 which are located between upper and lower manifolds 46 and 48 are supported by the same brackets 50 and 52 by which the manifolds are mounted to the side wall of duct or conduit 32.

A plurality of tubes designated generally as 58 are connected to manifolds 46 and 48 after extending generally horizontally back and forth across conduit 32 in a serpentine manner. Tubes 58 have a plurality of generally straight segments 60 connected to and extending between the plurality of bights 62. As indicated in FIGS. 3 and 4, bights 62, and therefore, tubes 58, are oriented in a vertical direction which corresponds to the direction of the flow of the air and water flowing externally through the coil assembly. Adjacent tubes, for example, tubes **58*a* and 58*b* in FIGS. 3 and 4 preferably are arranged in alternately vertically offset arrays, such that the segments of every other tube are generally aligned in the same horizontal plane, but above or below the next adjacent tube. Thus, for example, as best illustrated in FIG. 4, segment 60*a* of tube 58*a* is located above segment 60*b* of tube 58*b*. As illustrated in FIG. 4**, the vertical spacing of the tubes preferably is such that the vertical spaces between the segments of adjacent tubes are substantially equal.

While the number of segments and bights depend upon the overall design of the heat exchange system, typically, the coil assembly of the present invention includes between 3 and 11 bights 62 which are connected to between 4 and 12 segments 60. Also, in a typical counterflow evaporative heat exchanger with cross sectional dimensions of about 57 inches by twelve feet, 53 tubes with an outside diameter of 1.05 inches could extend across the duct or conduit. So that a coil assembly having tubes with the maximum amount of surface area per any given cross sectional area of the duct or conduit can be attained, the tubes are arranged such that the bights 62 contact each other. This is best illustrated in FIG. 3 where bights **62*c*, 62*d*, 62*e* and 62*f*** clearly contact each other. Thus, the bights of the coil assembly of the present invention are in a tight packed arrangement, substantially identical to the bights in a prior art tight packed coil assembly.

Unlike the prior art tight packed coil assembly, however, the coil assembly of the present invention is constructed to provide for spaces between adjacent segments 60 of adjacent tubes 58 at different levels. These spaces are clearly illustrated in FIG. 3 as being between segments **60*c*, 60*d*, 60*e* and 60*f* of tubes 58*c*, 58*d*, 58*e* and 58*f*, respectively. More importantly, adjacent segments at the same horizontal level are spaced laterally from each other by a greater distance than segments of tubes in the prior art tight packed coil assembly. The increased spacing between adjacent segments at the same horizontal level can be seen with reference to FIGS. 3 and 5, and specifically, such spacing is represented by the spacing between segments 60*c* and 60*e* of tubes 58*c* and 58*e*, respectively, at a higher horizontal level, and by the spacing between segments 60*d* and 60*f* of tubes 58*d* and 58*f***, respectively, at a lower horizontal level.

By virtue of the spaced adjacent segments at different levels and the increased spacing between adjacent segments at the same horizontal level, the coil assembly of the present invention has some similarity to the prior art spaced tube coil assembly. However, as explained herein, the coil assembly of the present invention is even more efficient than the prior art spaced tube coil assembly and provides some surprising and unexpected advantages.

The spacing of the segments in the coil assembly of the present invention is achieved by virtue of making the tubes with two different cross sectional transverse (preferably horizontal) dimensions, whereby such cross sectional transverse dimension of the segments is less than that of the bights. To provide for efficient heat transfer between the external and internal fluids as explained above, segments 60 have a generally elliptical cross sectional shape whereby the segments of adjacent tubes at the same level are spaced apart from each other due to their elliptical shape by an amount greater than the cross sectional transverse dimension of the bights, which may have a generally circular or generally elliptical cross sectional shape, such that the flow of the air and water externally through the coil assembly is not adversely affected. The major axis of each tube segment 60 preferably is oriented in a vertical plane. However, as explained below in detail, the major axis of the ellipses may be oriented at varying angles at random with respect to the vertical plane and may even be skewed at opposite angles in adjacent tubes as long as a space is maintained between adjacent tubes in a direction transverse to the flow direction of the air and water externally through the coil assembly. Tubing having segments with an elliptical cross sectional shape can be formed readily by techniques well known to those of ordinary skill in the art.

Further details of the coil assembly of the present invention, and particularly the characteristics of the present invention compared to the prior art, will be described with respect to FIGS. 5–7.

Figure 5:
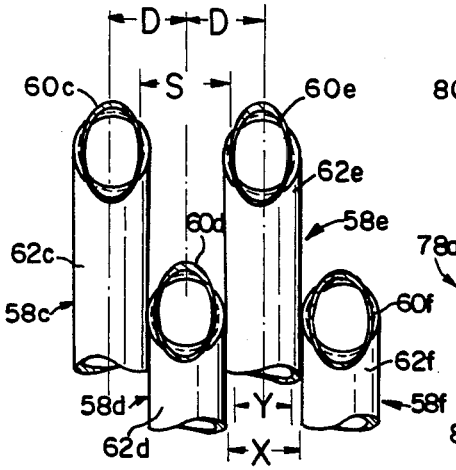
FIG. 5 is a vertical sectional view, partially broken away, of portion of the coil assembly of the present invention taken along line 5—5 of FIG. 3 and in which a support rod has been eliminated for clarity of illustration.

FIG. 5 illustrates a first and presently preferred embodiment of a portion of a coil assembly taken along line 5—5 of FIG. 3. For the purpose of clarity, support rod 64 has been eliminated in FIG. 5. FIG. 5 illustrates four adjacent tubes 58*c*, 58*d*, 58*e* and 58*f* Which include segments 60*c*, 60*d*, 60*e* and 60*f*, respectively, as well as bights 62*c*, 62*d*, 62*e* and 62*f*, respectively. In the embodiment of FIG. 5, bights 62 have a generally circular cross sectional shape, at least where they join segments 60. Each of the tubes 58 at bights 62 has a diameter of X. Since the bights are in contact with each other, the distance D between the centerlines of the bights of adjacent tubes, for example tubes 58*c* and 58*d* and tubes 58*d* and 58*e*, each equals the diameter X. Thus, the distance between the centerlines of adjacent tubes on the same horizontal level, namely, tubes 58*c* and 58*e* or tubes 58*d* and 58*f*, equals two times D, or 2X.

Also as illustrated in FIG. 5, the segments of adjacent tubes at the same level have an open space S between them by virtue of the elliptical shape of the segments which are automatically spaced from each other. Because the dimension of the minor axis Y of the elliptical segments 60 is less than the diameter X of the bights 62, the open space $S=2D-Y$ and is greater than X. The minor axis of the ellipse corresponds to the transverse cross sectional dimension in a direction transverse to the flow direction of the water and air externally through the coil assembly and transverse to the longitudinal axis of the segment. It is preferred that this dimension, and specifically the minor axis, have a length or dimension Y of about 0.5 to about 0.9 times, and most preferably, about 0.8 times the diameter X of the bight. Thus, using the foregoing formula, the space S between segments of adjacent tubes of the same level in a horizontal direction preferably is between about 1.1 and about 1.5 times the diameter or dimension X.

The larger space between segments of adjacent tubes at the same level allows for more efficient airflow between the tubes of the coil assembly, providing for more efficient evaporation and better thermal performance and efficiency than if there were smaller spaces between the segments of adjacent tubes at the same level as in the tight packed coil assembly of the prior art. The larger space between the segments of adjacent tubes in the same level provides for more efficient (eased) airflow between the segments of the coil assembly. A possible concern, however, is that the eased airflow is streamlined, less turbulent and even bypasses the tube segments completely. This would result in a loss of heat transfer capacity. However, surprisingly, this does not occur. The open space between the tube segments, the high coil surface area and the higher spray water flow rates combine to improve the evaporation and thermal performance over the tight packed coil assembly of the prior art. A typical prior art tight packed coil assembly is illustrated in FIG. 6 for purposes of comparison with FIG. 5.

Figure 6:
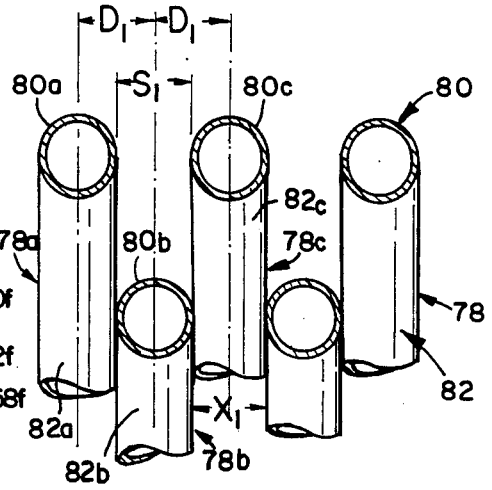
FIG. 6 PRIOR ART
FIG. 6 is a view similar to FIG. 5 illustrating the tube arrangement in a prior art tight packed coil assembly.

With reference to FIG. 6, the tight packed prior art coil assembly includes tubes 78 having segments 80 and bights 82. It is clear from FIG. 6 that the tubes used in the prior art tight packed coil assembly have a uniform cross sectional shape with a uniform cross sectional dimension throughout the length of each tube. Thus, the cross sectional dimension of segments 80 equals the cross sectional dimension of bights 82, namely, the diameter of the tube, represented as $X_1$. This distance $D_1$ between the centerlines of adjacent tubes 78*a* and 78*b* or between adjacent tubes 78*b* and 78*c* is equal to the diameter or distance $X_1$. Accordingly, the distance between the centerlines of two segments on the same level, namely segments 80*a* and 80*c*, equals two times $D_1$, which equals two times $X_1$ or twice the diameter of the tubes, since they are packed as tightly as can be. In this case the open space between tubes at the same level S is always equal to $2D_1-X_1$, which equals $D_1$.

Figure 7:
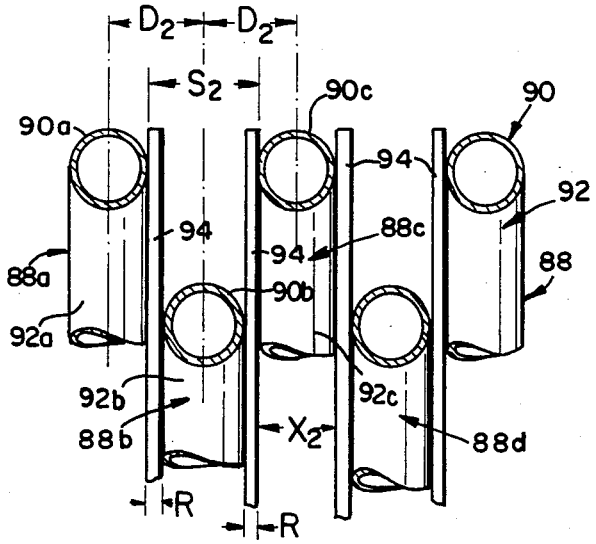
FIG. 7 PRIOR ART
FIG. 7 is a view similar to FIGS. 5 and 6 illustrating the tube and spacer bar arrangement in a prior art spaced tube coil assembly.

FIG. 7 illustrates a portion of a prior art spaced tube coil assembly for the purpose of the comparison with FIG. 5 illustrating the present invention and FIG. 6 illustrating the tight packed coil assembly. The spaced tube coil assembly illustrated in FIG. 7 includes a plurality of tubes 88 having segments 90 and bights 92. Adjacent tubes are spaced from each other laterally by spacer rods 94. Thus, bights 92 of adjacent tubes 88 are not in contact with each other as in the present invention or as in the prior art tight packed coil assembly. As with the prior art tight packed coil assembly, tubes 88 of the prior art spaced tube coil assembly have a uniform cross sectional shape, generally circular, having a cross sectional dimension $X_2$, corresponding to the diameter of the tube. Spacer rods 94 space adjacent tubes from each other by a distance R. Accordingly, the distance $D_2$ between the centerlines of the segments of adjacent tubes, such as segments 90*a* and 90*b* or segments 90*b* and 90*c*, is equal to the distance $X_2$ plus R. Therefore, the distance between segments of adjacent tubes at the same level, namely the distance $S_2$ between segments 90*a* and 90*c*, is $2D_2-X_2$, or $X_2+2R$.

It should be clear from the foregoing and a review of FIGS. 5–7 that for the same size tubing, $D_2$ is greater than D. Accordingly, more tubes can be used in a coil assembly having a given width than could be used in the prior art spaced tube coil assembly illustrated in FIG. 7, assuming that the tube diameter of the bights is the same (that is, where $X=X_2$) This results in the significant advantages of the present invention over the prior art as discussed above, namely, it achieves higher thermal performance with 20% more coil surface area and 20–25% lower internal pressure drop.

It is presently preferred that the tubes used in a coil assembly of the present invention have bights with a circular cross sectional shape. Nevertheless, the present invention is not limited to tubing having a circular cross section. Rather, coil assemblies according to the present invention can be made from tubing of any cross sectional shape, as long as the cross sectional dimension of the segments corresponding to dimension Y of FIG. 5 is less than the cross sectional dimension of the bights corresponding to dimension X of FIG. 5.

Figure 8:
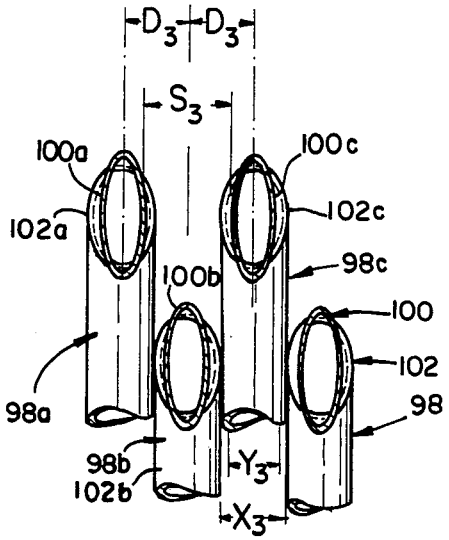
FIG. 8 is a view similar to FIG. 5 illustrating the arrangement of tubes in an alternate embodiment of a coil assembly according to the present invention.

FIG. 8 illustrates another embodiment of the present invention in which the tubing has an elliptical cross sectional shape such that the major axis of the ellipse in the segments and at the bight where the bights are joined with the segments is parallel to the direction that the air and water flows externally through the coil assembly.

The coil assembly of FIG. 8 includes an array of tubes 98 having segments 100 and bights 102. Bights 102*a*, 102*b* and 102*c* of tubes 98*a*, 98*b* and 98*c*, respectively, are in contact with each other. Bights 98 have a cross sectional dimension $X_3$. Segments 100 have a cross sectional dimension $Y_3$. The distance $D_3$ between adjacent tubes 98, such as the distance between the centerlines of tubes 98*a* and 98*b* or tubes 98*b* or 98*c* substantially equals the dimension $X_3$, since the bights are in contact. Thus, the distance between the centerline of segments of adjacent tubes on the same level, namely segments 100a and 100c, equals two times $D_3$ which equals 2 times $X_3$. The space $S_3$ between adjacent segments at the same level, namely the space between segments 100a and 100c, equals $2X_3-Y_3$, which is greater than $X_3$.

Although the segments may be flattened as indicated in FIG. 8 to almost any extent, as a practical matter, due to the trade off between performance which may be adversely affected by restricting the flow of the internal heat transfer fluid inside the tubing of the coil assembly and the increase in performance by increasing turbulence within the tubes and the increased water coating and airflow externally through the coil assembly, the dimension $Y_3$ should be no less than 0.5 times the dimension $X_3$. Preferably, the dimension $Y_3$ equals 0.8 times $X_3$. These are the same preferred relationships which applied with respect to the embodiment illustrated in FIG. 5. Thus, in the presently preferred embodiment of FIG. 8, $Y_3$ equals 0.8 times $X_3$.

By using tubes having an elliptical cross sectional shape, such as that illustrated in FIG. 8, the effect is to provide even more tubes with even more total surface area to be built into a coil assembly having a given total plan area. In the past this was thought to be impossible and impractical and is contrary to the teachings of U.S. Pat. No. 4,196,157. However, this invention has made it both possible and practical to achieve. This feature of additional surface area would be particularly useful in applications demanding more surface area, such as laminar flows or intermittent dry operation cycles.

Figure 9:
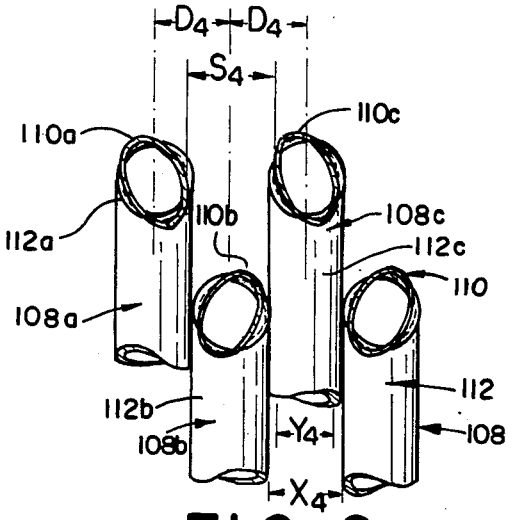
FIG. 9 is a view similar to FIG. 5 illustrating the arrangement of tubes in yet another embodiment of a coil assembly according to the present invention.

FIG. 9 illustrates yet another embodiment of a coil assembly according to the present invention in which the major axis of the elliptical segments of the tubes are angled with respect to the flow direction of the external heat exchange fluids passing through the coil assembly. FIG. 9 illustrates a particular preferred embodiment of such a coil assembly having angled elliptical segments, in which the major axes of the elliptical segments on adjacent tubes at different levels are angled in opposite directions with respect to each other and with respect to the vertical plane, which represents the most common flow direction for the external air and water through the coil assembly.

The coil assembly of FIG. 9 includes tubes 108 having segments 110 and bights 112. The tubes in the area of the bights, and particularly in the areas where the bights join the segments, may have any suitable cross sectional shape, but a circular cross sectional shape is illustrated in FIG. 9. Bights 112a, 112b and 112c of tubes 108a, 108b and 108c, respectively, are in contact with each other. The tubing has a diameter or cross sectional dimension $X_4$ in the area of the bights particularly where the bights join the segments. The angled elliptical segments at the same level, for example segments 110a and 110c, are spaced apart a greater distance than the diameter or cross sectional dimension $X_4$ of the bights. $Y_4$ is the cross sectional dimension of the angled elliptical segments 110.

As in the other embodiments of the present invention, the distance $D_4$ between the centerlines of adjacent tubes 108, such as the distance between the centerlines of tubes 108a and 108b or tubes 108b and 108c equals the distance $X_4$. The distance between the centerlines of segments of adjacent tubes at the same level, namely, the distance between the centerlines of segments of 110a and 110c, is two times $D_4$. The space $S_4$ between segments of adjacent tubes at the same level, namely, between segments 110a and 110c is $2X_4-Y_4$.

The major axes of the elliptical segments can be angled up to 45 degrees on either side of a vertical plane corresponding to the flow direction of the external fluids through the coil assembly. Angles of up to 40 degrees on either side of the vertical plane are preferred, such that the angle of the major axis of elliptical segment 110a may be at 40 degrees, while the angle of the major axis of elliptical segment 110b of the adjacent tube is at 320 degrees from the same vertical plane.

As the major axes of the elliptical segments of the tubes are oriented at greater angles approaching right angles away from the vertical plane, they will cause increased turbulence in the air and water flows. The angled segments present more tube surface area to the air and water flow streams, but they also reduce the space $S_4$ between segments at the same level and may restrict the airflow. It is believed that the trade-off between the improved turbulence and the reduced airflow would be favorable as long as the space $S_4$ is maintained greater than $X_4$.

The present invention may be embodied in other specific forms without departing from the spirit or central attributes thereof and, accordingly, reference should be made to the appended claims, rather than to the foregoing specification as indicating the scope of the invention.

We claim:

1. An evaporative heat exchanger comprising a conduit having a longitudinal axis, means for spraying a first external heat exchange fluid in the form of a liquid within the conduit, means for causing a second external heat exchange fluid in the form of a gas to flow through the conduit in a direction parallel to or countercurrent to the direction of the liquid external heat exchange fluid, and a coil assembly having a major plane and being mounted within the conduit such that the major plane is generally normal to the longitudinal axis of the conduit and such that the external heat exchange fluids flow externally through the coil assembly in a flow direction generally normal to the major plane of the coil assembly, the coil assembly comprising inlet and outlet manifolds and a plurality of tubes connecting the manifolds, the tubes having a plurality of segments and a plurality of bights, the bights being oriented in planes parallel to the flow direction, the segments of each tube connecting the bights of each tube and extending between the bights in a direction generally normal to the flow direction, the bights of each tube being in contact with the bights of adjacent tubes, the segments having a generally elliptical cross sectional shape such that the segments of adjacent tubes are spaced from each other within planes generally parallel to the major plane, the segments of adjacent tubes in the planes generally parallel to the major plane being staggered and spaced with respect to each other in the flow direction to form a plurality of staggered levels in which every other segment is aligned in the same level generally parallel to the major plane, wherein each bight has a transverse cross sectional dimension in a direction transverse to the flow direction and transverse to the longitudinal axis of the segment connected to the bight, the distance between the centerline of adjacent bights substantially equalling the transverse cross sectional dimension, the space between segments of adjacent tubes at the same level being between about 1.1 and about 1.5 times the transverse cross sectional dimension of the bight.

2. An evaporative heat exchanger according to claim 1 wherein the space between segments of adjacent tubes at the same level is about 1.2 times the transverse cross sectional dimension of the bight.

3. An evaporative heat exchanger acording to claim 1 wherein the elliptical segments have curved walls.

4. An evaporative heat exchanger according to claim 1 wherein the gas external heat exchange fluid flows in a direction parallel to the direction in which the liquid external heat exchange fluid flows.

5. An evaporative heat exchanger according to claim 1 wherein the gas external heat exchange fluid flows in a direction countercurrent to the direction in which the liquid external heat exchange fluid flows.

6. An evaporative heat exchanger according to claim 1 wherein the flow direction is generally vertical.

7. An evaporative heat exchanger according to claim 1 wherein the bights have a circular cross sectional shape.

8. An evaporative heat exchanger according to claim 7 wherein the generally elliptical cross sectional shape of the segments includes a major axis and a minor axis, the major axis being generally parallel to the plane of the bights.

9. An evaporative heat exchanger according to claim 1 wherein the generally elliptical cross sectional shape of the segments includes a major axis and a minor axis, the major axis being angled with respect to the plane of the bights.

10. An evaporative heat exchanger according to claim 9 wherein the major axes of the segments of adjacent tubes on different levels are angled in opposite directions with respect to each other and to the plane of the bights.

11. An avaporative heat exchanger according to claim 10 wherein the angle of the major axis on one level is 40 degrees from a verticla plane parallel to the longitudinal axis of the conduit and the angle of the major axis on the adjacent different level is 320 degrees from the vertical plane.

12. An evaporative heat exchanger according to claim 1 wherein the bights have a generally elliptical cross sectional shape with a major axis and a minor axis, the minor axis defining the transverse cross sectional dimension.

13. An evaporative heat exchanger according to claim 1 wherein the tubes of the coil assembly extend back and forth across the conduit in a serpentine manner betwen a common upper manifold and a common lower manifold in planes parallel to the flow direction.

14. An evaporative heat exchanger according to claim 1 wherein the liquid external heat exchange fluid is water having a flow rate of up to 8 gallons/minute/-square foot of area occupied by the coil assembly in the major plane.

* * * * *